US006137228A

United States Patent [19]

Aizawa et al.

[11] Patent Number: 6,137,228

[45] Date of Patent: Oct. 24, 2000

[54] METAL HALIDE LAMPS WITH TUNGSTEN COILS HAVING VARYING PITCHES AND INNER DIAMETERS

[75] Inventors: Masanobu Aizawa; Tsuneyoshi Sibasaki; Mitsugu Tayama; Masatomo Yanai; Akihiko Tsurumaru, all of Iwaki, Japan

[73] Assignee: Stanley Electric Co., Ltd., Japan

[21] Appl. No.: 09/039,722

[22] Filed: Mar. 16, 1998

[30] Foreign Application Priority Data

Mar. 21, 1997 [JP] Japan ..... 9-068011

[51] Int. Cl.[7] ..... H01J 17/04; H01J 61/04; H01J 17/20; H01J 61/12; H01J 1/62

[52] U.S. Cl. ..... 313/631; 313/491; 313/574; 313/631; 313/632; 445/23; 445/35; 445/29; 445/33

[58] Field of Search ..... 445/23, 26, 24, 445/32–33, 46, 48, 35; 313/573–74, 579, 620–21, 623, 628, 631–32, 634, 638–39, 640–43, 491–493

[56] References Cited

U.S. PATENT DOCUMENTS 4,724,358 2/1988 Inukai ..... 313/632 X
4,968,916 11/1990 Davenport et al. ..... 313/631 X
5,107,165 4/1992 Dever et al. ..... 313/632 X
5,936,350 8/1999 Yoshida et al. ..... 313/631

*Primary Examiner*—Nimeshkumar D. Patel
*Assistant Examiner*—Mack Haynes
*Attorney, Agent, or Firm*—Ostrolenk, Faber, Gerb & Soffen, LLP

[57] ABSTRACT

A method for manufacturing a metal halide lamp in which tungsten coils are made to have diameters wider than the outer diameters of electrodes, and to have a coil pitch sufficient to prevent molten quartz glass from entering therebetween; and after the tungsten coils have been fixed around the electrodes, the pitch of the tungsten coils on the sides of the electrodes which are nearest molybdenum foils is extended by dragging a part of the tungsten coils toward the discharge ends of the electrodes to fix it tightly around the electrodes. As a result, when sealing is performed with quartz glass bulb, gaps between the electrodes and the glass bulb are provided on the discharge sides of the electrodes, whereby it can be prevented to occur cracks in the quartz glass bulb due to the thermal expansion of the electrodes; and on the molybdenum foil sides of the electrodes, the quartz glass bulb contacts the electrodes, thereby preventing peeling-off and accumulation of sealed material.

5 Claims, 2 Drawing Sheets

METAL HALIDE LAMPS WITH TUNGSTEN COILS HAVING VARYING PITCHES AND INNER DIAMETERS

BACKGROUND OF THE INVENTION

1. Field of the Invention

The present invention relates to a metal halide lamp and a method for manufacturing the same, and more particularly to a metal halide discharge lamp, achieving a considerable improvement in visibility and therefore used as an alternative to an incandescent bulb, such as a halogen bulb, which has been used as a light source in conventional vehicle head lamps, and a method for manufacturing the same.

2. Background Art

FIG. 5 shows an example configuration of a conventional metal halide lamp 90 of this type. As shown in the figure, the metal halide lamp 90 has a discharge chamber (a burner) 92 formed of a quartz glass bulb 91. A pair of tungsten electrodes 93 are provided inside the discharge chamber 92 with their respective discharge ends 93*a* facing each other. Tungsten coils 94 are fixed around the electrodes 93, and molybdenum foils 95 are welded to the ends of the electrodes 93 which are opposite to the discharge ends 93*a*. In addition, lead-in wires 96 for supplying current from outside to the electrodes 93 are connected to the molybdenum foils 95.

FIG. 6 shows the main parts of the metal halide lamp 90. When the electrode 93 is directly contacted to the quartz glass bulb 91, cracks in the quartz glass bulb 91 is caused and consequently leaks occurs due to the thermal expansion of the electrode 93 resulting from the increase in temperature when the lamp is lit. Therefore, the tungsten coil 94 having a greater inner diameter than the outer diameter of the electrode 93 is fixed around the electrode 93 in order to prohibit direct contact between the electrode 93 and the quartz glass bulb 91, thereby preventing such cracks.

However, in the conventional metal halide lamp 90 constructed as above, a gap D is created between the electrode 93 and the quartz glass bulb 91 by fixing the tungsten coil 94 around the electrode 93. As shown in FIG. 6, this gap D reaches as far as the end of the electrode 93 to which the molybdenum foil 95 has been provided.

As a result, there is a problem that metal halide and mercury sealed within the discharge chamber 92 escape along the gap D to reach the molybdenum foil 95, thereby causing peeling off the molybdenum foil 95 from the quartz glass bulb 91. Such peeling-off may cause leaks in the discharge chamber 92, shortening the useful life of the metal halide lamp 90.

Furthermore, when metal halide and mercury enter into the gap D as described above, the amount of metal halide and mercury sealed within the discharge chamber 92 may consequently be decreased, resulting in a reduced amount of light when the lamp is lit. In the case of a head lamp, a reduction in the amount of light to 70% of the initial amount of light is regarded as necessitating the replacement of the head lamp. Therefore, the useful life of the lamp may be reduced even when no leaks actually occur in the discharge chamber 92 as described above.

SUMMARY OF THE INVENTION

An object of the present invention to solve the above-mentioned problems is to provide a method for manufacturing a metal halide lamp, which comprises:

a quartz glass bulb forming a discharge chamber;

a pair of electrodes, discharge ends of the electrodes being provided so as to face each other within the discharge chamber;

tungsten coils respectively fixed around the electrodes;

molybdenum foils respectively connected to ends of the electrodes which are opposite to the discharge ends thereof; and lead-in wires for supplying current from outside to the electrodes, the lead-in wires being respectively connected to the molybdenum foils;

the method comprising the steps of:

forming the tungsten coils to have an inner diameter thereof appropriately greater than an outer diameter of the electrodes, and to have a pitch thereof such that molten quartz glass does not enter between the coils when sealed with the quartz glass bulb;

welding one end of the respective tungsten coils to the respective molybdenum foils, to which said electrodes are connected after the tungsten coils have been fixed around the electrodes;

holding the tungsten coils at a position roughly halfway along the lengths thereof and dragging the respective tungsten coils that extend from the respective molybdenum foils in a direction toward discharge ends of the electrodes, thereby stretching the pitch of the respective portions of the tungsten coils on the molybdenum foil sides and also thoroughly tightly fixing the portions that extend from the respective molybdenum foils the tungsten coils around the electrodes; and sealing the tungsten coils, which have been fixed to the electrodes, by means of the quartz glass bulb.

Furthermore, the ends of the tungsten coils which are welded to the molybdenum foils may preferably be formed as leg portions extending parallel to an axes of the tungsten coils.

Further, another object of the present invention is to provide a metal halide lamp comprising:

a quartz glass bulb forming a discharge chamber;

a pair of electrodes, discharge ends of the electrodes being provided so as to face each other within the discharge chamber;

tungsten coils respectively fixed around the electrodes;

molybdenum foils respectively connected to ends of the electrodes which are opposite to the discharge ends;

lead-in wires for supplying current from outside to the electrodes, the lead-in wires being respectively connected to the molybdenum foils; wherein the tungsten coils having been fixed around the electrodes are sealed by means of the quartz glass bulb;

the portions of said tungsten that extend from the respective molybdenum foils to a position that is roughly halfway along the lengths of respective electrodes are tightly fixed around the electrodes, the coil pitch of the tungsten coils being sufficiently wide that molten quartz glass reaches the electrodes; and inner diameters of the tungsten coils along roughly half-length portions of the electrodes on discharge sides thereof is set to provide an appropriate gap between the coils and the electrodes, and the coil pitch of the portions of the tungsten coils that extend from the respective molybdenum foils is sufficiently narrow that molten quartz glass does not reach the electrodes.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The present invention is described in detail hereinafter with reference to an embodiment shown in the accompanying drawings.

Figure 1:
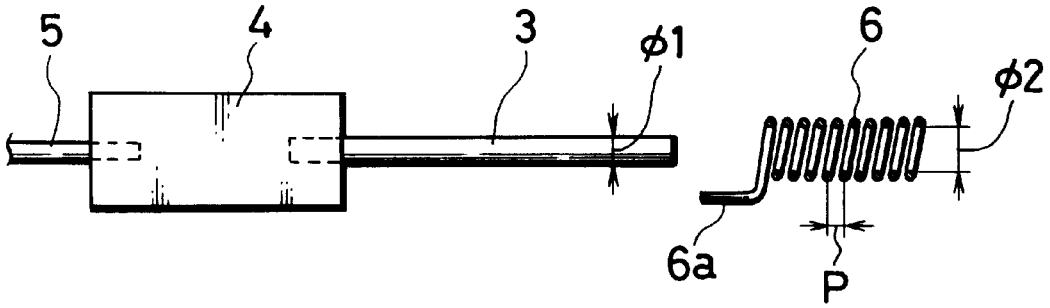
FIG. 1 is an explanatory view of a first step of fixing a tungsten coil around an electrode according to an embodiment of the metal halide lamp manufacturing method of the present invention.
Figure 2:
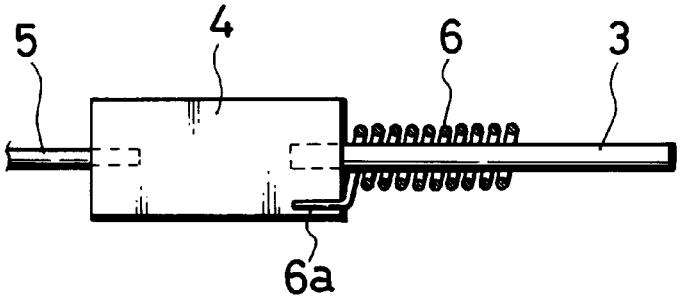
FIG. 2 is an explanatory view of a second step of fixing the tungsten coil around the electrode in the same embodiment.
Figure 3:
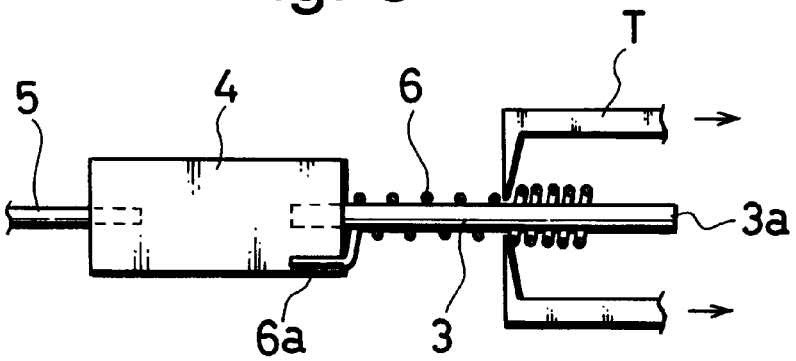
FIG. 3 is an explanatory view of a fabricating process of the tungsten coil in the same embodiment.

FIGS. 1~3 show a sequence of steps in the method for manufacturing a metal halide lamp 1 according to the present invention. As shown in FIG. 1, the present invention resembles the prior art in respect of the points that one end of a molybdenum foil 4 is connected to an electrode 3, while the other end of the molybdenum foil 4 is connected to a lead-in wire 5, and a tungsten coil 6 is fixed around the electrode 3. A further similarity to the prior art is that the inner diameter Φ2 of the tungsten coil 6 is appropriately greater than the outer diameter Φ1 of the electrode 3.

The present invention further comprises a leg portion 6*a* which is provided at one end of the tungsten coil 6 and extends toward the molybdenum foil 4 parallel to an axis of the tungsten coil 6.

Here, the tungsten coil 6 is wound thoroughly tight or at an extremely narrow coil pitch P, in order to prevent the quartz glass bulb 2 (not shown in FIG. 1), which is molten when the lamp is sealed, from entering gaps formed by the coil pitch P.

As shown in FIG. 2, the tungsten coil 6 formed as above is fixed around the electrode 3. In addition, the leg portion 6*a* thereof is connected to the molybdenum foil 4 by a suitable method, such as spot welding, whereby the molybdenum foil 4 and the tungsten coil 6 are joined in a single unit. As shown in FIG. 3, the tungsten coil 6 is then held at a position roughly halfway along the length thereof by a tool T having, for instance, a thin-blade shape. The coil 6 is then dragged toward the discharge end 3*a* of the electrode 3 thereby partially stretching the tungsten coil 6.

As a consequence, the shape of the tungsten coil 6 is changed. More specifically, the inner diameter Φ2 of roughly half of the tungsten coil 6, on the side of the tungsten coil 6 which is nearest the molybdenum foil 4, is decreased, and the coil pitch P is simultaneously widened. Thus, according to the present invention, by adjusting the stretching force given to the tool T, the initial inner diameter Φ2 of the tungsten coil 6 can be permanently altered so as to fit tightly to the outer diameter Φ1 of the electrode 3.

Figure 4:
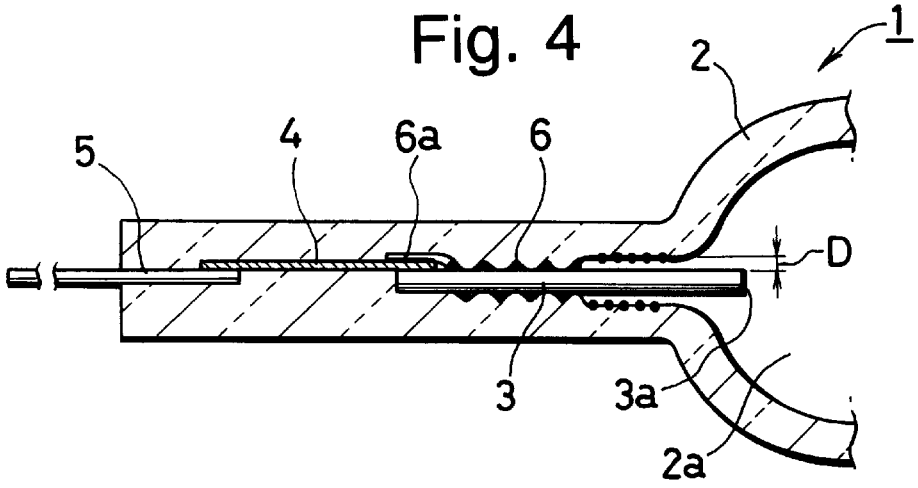
FIG. 4 is a cross-sectional view of the main parts of the same embodiment of the metal halide lamp of the present invention.
Figure 5:
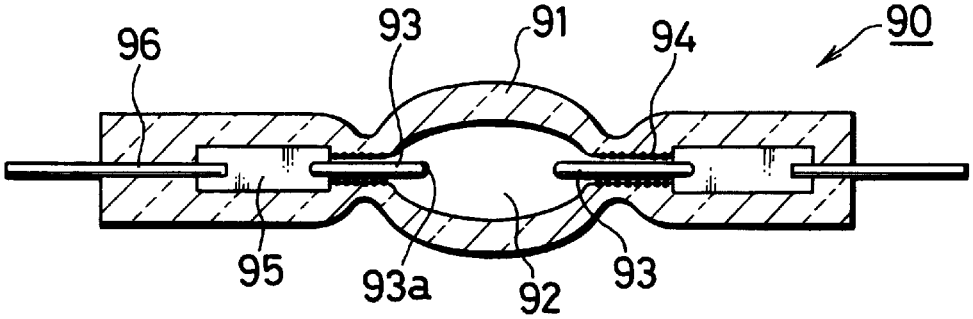
Fig. 5 Prior Art
FIG. 5 is a cross-sectional view of a prior art.
Figure 6:
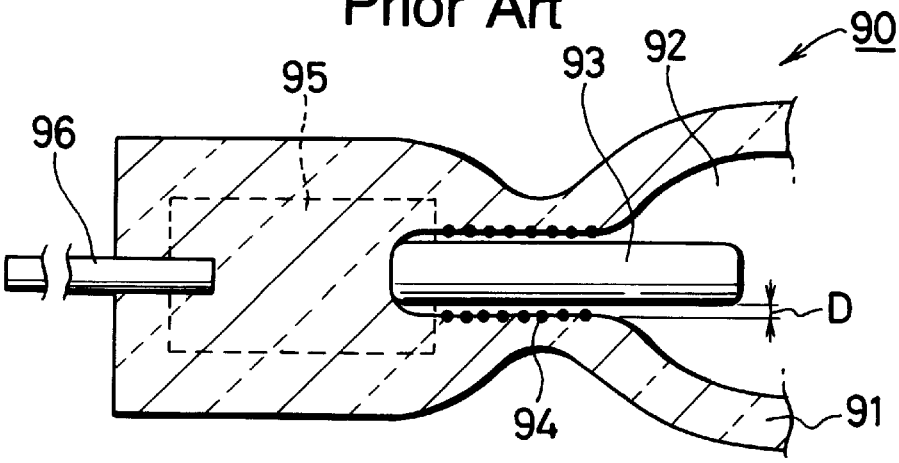
Fig. 6 Prior Art
FIG. 6 is an enlarged cross-sectional view of the main parts of the same prior art.

FIG. 4 shows the main parts of the metal halide lamp 1 which has been obtained by the processes described above. After altering the shape of the tungsten coil 6 in the above manner, the portion of the tungsten coil 6 which has not been altered in shape, namely the portion having the initial inner diameter of Φ2, covers the portion of the electrode 3 which is nearest the discharge side 3*a*. Furthermore, the coil pitch P of this portion is made thoroughly tightly or at a sufficiently narrow pitch. Therefore, even during sealing, the molten quartz glass bulb 2 does not enter the inside of the coil, enabling an appropriate gap D to be maintained between the quartz glass bulb 2 and the electrode 3.

By contrast, on the portion of the electrode 3 which is nearest the molybdenum foil 4, the inner diameter Φ2 of the tungsten coil 6 has been reduced, and the tungsten coil 6 therefore touches the periphery of the electrode 3. Moreover, since the tungsten coil 6 of this portion has been stretched, the coil pitch P is wider. As a result, during sealing, the molten quartz glass bulb 2 enters between the coils and touches the outer periphery of the electrode 3 or becomes welded thereto.

Thus, in the metal halide lamp 1 of the present invention, the gap D is provided between the quartz glass bulb 2 and the electrode 3 in the portion of the electrode 3 nearest the discharge end 3*a*, this being the portion which becomes particularly hot when the lamp is lit, in order to prevent cracks from occurring in the quartz glass bulb 2.

Furthermore, in the portion of the electrode 3 which is nearest the molybdenum foil 4, the quartz glass bulb 2 contacts the outer periphery of the electrode 3. The entering of metal halide and mercury into this portion is thereby prohibited, and they do not reach the molybdenum foil 4. As a result, peeling off the molybdenum foil 4 from the quartz glass bulb 2 caused by the entering of metal halide and mercury, which was a problem in the prior art, is prevented.

In addition, since the range (length in the axial direction of the coil) of the gap D provided between the electrode 3 and the quartz glass bulb 2 is reduced in the metal halide lamp 1 of the present invention, the amount of metal halide and mercury accumulated in this gap D is also reduced. Consequently, it may be prevented to short the amount of metal halide and mercury sealed within the discharge chamber 2*a*, thereby improving the useful life of the metal halide lamp.

According to the present invention described above, when the electrode is sealed inside a quartz glass bulb, a gap of appropriate width is provided between the quartz glass bulb and the electrode on the portion near the discharge end of the electrode, this being the portion of the electrode which becomes hot when the lamp is lit. As a result, it can be prevented to occur cracks leading to leaks in the quartz glass bulb due to the thermal expansion of the electrode 3. This has an excellent effect of prolonging the useful life of the metal halide lamp.

Furthermore, on the portion of the electrode which is nearest the molybdenum foil, the tungsten coil is fitted thoroughly tightly around the electrode with a widened coil pitch, so that the quartz glass bulb and the electrode contact each other. The metal halide and the mercury are thus prevented from entering into this contact portion and from reaching the molybdenum foil. Consequently, peeling off the molybdenum foil from the quartz glass bulb, caused by the entering of metal halide and mercury, is prevented. This also has an excellent effect of prolonging the useful life of the metal halide lamp.

Moreover, in the present invention, the length of the gap, provided between the quartz glass bulb and the electrode, is shortened, thereby reducing the amount of metal halide and mercury accumulated within the gap. Consequently, the shortage of metal halide and mercury sealed within the discharge chamber due to the accumulation can be prevented, thereby improving the life expectancy of the metal halide lamp. Taken in conjunction, the advantageous effects of the present invention described above reliably extend the useful life of the metal halide lamp, as well as increasing reliability.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. A metal halide lamp comprising:

a quartz glass bulb forming a discharge chamber;

a pair of electrodes, discharge ends of said electrodes being provided so as to face each other within said discharge chamber;

tungsten coils respectively fixed around said electrodes;

molybdenum foils respectively connected to ends of said electrodes which are opposite to said discharge ends; and lead-in wires for supplying current from outside to the electrodes, said lead-in wires being respectively connected to said molybdenum foils; wherein said tungsten coils, having been fixed around said electrodes, are sealed by means of said quartz glass bulb; portions of said tungsten coils that extend from respective molybdenum foils to a position that is roughly halfway along the lengths of respective electrodes are tightly fixed around said electrodes, the coil pitch of said tungsten coils being sufficiently wide that molten quartz glass reaches said electrodes; and inner diameters of portions of said tungsten coils that extend from a position that is halfway along the lengths of the respective electrodes to said discharge ends of said respective electrodes are set to provide an appropriate gap between the coils and said electrodes, and the coil pitch of said portions of said tungsten coils that extend from said position that is halfway along the lengths of said respective electrodes to the discharge ends of said respective electrodes is sufficiently narrow such that molten quartz does not reach the electrodes.

2. A method for manufacturing a metal halide lamp comprising:

quartz glass bulb forming a discharge chamber;

a pair of electrodes, discharge ends of said electrodes being provided so as to face each other within said discharge chamber;

tungsten coils respectively fixed around said electrodes;

molybdenum foils respectively connected to ends of said electrodes which are opposite to said discharge ends thereof; and lead-in wires for supplying current from outside to said electrodes, said lead-in wires being respectively connected to said molybdenum foils;

said method comprising the steps of:

forming said tungsten coils to have an inner diameter thereof appropriately greater than the outer diameter of said electrodes, and to have a pitch thereof in such manner that molten quartz glass does not enter between the coils of said tungsten coils when sealed with said quartz glass bulb;

welding one end of said respective tungsten coils to said respective molybdenum foils, to which said electrodes are connected, after said tungsten coils have been respectively fixed to said electrodes;

holding said tungsten coils at a position roughly halfway along the lengths thereof and stretching the respective portions said tungsten coils that extend from said respective molybdenum foils in a direction toward the discharge ends of said electrodes, thereby extending the pitch of the respective portions of said tungsten coils on the molybdenum foil sides and also thoroughly tightly fixing said tungsten coils to said electrodes; and sealing said tungsten coils, which have been fixed around said electrodes, by means of said quartz glass bulb.

3. A method for manufacturing a metal halide lamp according to claim 2, wherein said ends of said tungsten coils which are welded to said molybdenum foils are formed as leg portions extending parallel to an axes of said tungsten coils.

4. A method for manufacturing a metal halide lamp according to claim 3, wherein said tungsten coils are spot-welded to said molybdenum foils.

5. A method for manufacturing a metal halide lamp according to claim 2, wherein said tungsten coils are spot-welded to said molybdenum foils.

* * * * *